US010545436B2

(12) United States Patent
Watanabe

(10) Patent No.: US 10,545,436 B2
(45) Date of Patent: Jan. 28, 2020

(54) IMAGE FORMING SYSTEM HAVING MULTIPLE IMAGE FORMING UNITS

(71) Applicant: TOSHIBA TEC KABUSHIKI KAISHA, Tokyo (JP)

(72) Inventor: Takeshi Watanabe, Yokohama Kanagawa (JP)

(73) Assignee: Toshiba Tec Kabushiki Kaisha, Tokyo (JP)

( * ) Notice: Subject to any disclaimer, the term of this patent is extended or adjusted under 35 U.S.C. 154(b) by 0 days.

(21) Appl. No.: 16/052,327

(22) Filed: Aug. 1, 2018

(65) Prior Publication Data

US 2019/0129337 A1 May 2, 2019

(30) Foreign Application Priority Data

Oct. 26, 2017 (JP) ..... 2017-207219

(51) Int. Cl.
*G03G 15/20* (2006.01)
*G03G 15/00* (2006.01)
*G03G 15/01* (2006.01)

(52) U.S. Cl.
CPC ..... *G03G 15/2039* (2013.01); *G03G 15/6561* (2013.01); *G03G 15/0105* (2013.01); *G03G 15/6558* (2013.01); *G03G 15/6573* (2013.01); *G03G 2215/00021* (2013.01); *G03G 2215/00531* (2013.01)

(58) Field of Classification Search
CPC ..... G03G 15/2039; G03G 15/0105; G03G 15/6561; G03G 15/6558; G03G 15/6573; G03G 15/0194; G03G 13/20; G03G 13/22; G03G 15/0178; G03G 2215/00021; G03G 2215/00531; B41J 3/546; B41J 29/36
See application file for complete search history.

(56) References Cited

U.S. PATENT DOCUMENTS

| | | | | |
|---|---|---|---|---|
| 7,957,660 | B2 * | 6/2011 | Kaneko | B41J 29/38 399/67 |
| 8,478,151 | B2 | 7/2013 | Iguchi et al. | |
| 9,207,604 | B1 * | 12/2015 | Ise | G03G 15/2064 |
| 9,983,529 | B1 * | 5/2018 | Tanaka | G06F 3/1219 |
| 2010/0272449 | A1 * | 10/2010 | Yoshida | H04N 1/32133 399/2 |
| 2012/0045236 | A1 * | 2/2012 | Fukamachi | G03G 15/065 399/53 |

(Continued)

*Primary Examiner* — David M. Gray
*Assistant Examiner* — Laura Roth
(74) *Attorney, Agent, or Firm* — Kim & Stewart LLP

(57) ABSTRACT

An image forming system comprises a sheet supply section configured to supply a sheet for printing. The system includes a registration roller configured to guide the sheet supplied from the sheet supply section along a conveyance path. A first image forming section is configured to form a first image on the sheet based on reference image information using a first colorant type that is capable of being fixed to the sheet by heat. A fixing section is configured to heat the sheet on which the first image has been formed. A second image forming section is configured to receive the sheet from the fixing section and form a second image using a second colorant type on the sheet after the sheet has been passed through the fixing section. A controller is configured to control a heating temperature of the fixing section in two or more stages.

18 Claims, 5 Drawing Sheets

(56) References Cited

U.S. PATENT DOCUMENTS

| | | | | |
|---|---|---|---|---|
| 2012/0170064 | A1* | 7/2012 | Hibino | G06F 3/1205 358/1.9 |
| 2014/0255055 | A1* | 9/2014 | Katayama | G03G 15/2039 399/69 |
| 2015/0063848 | A1* | 3/2015 | Ikuta | G03G 15/6564 399/45 |

* cited by examiner

IMAGE FORMING SYSTEM HAVING MULTIPLE IMAGE FORMING UNITS

CROSS-REFERENCE TO RELATED APPLICATION

This application is based upon and claims the benefit of priority from Japanese Patent Application No. 2017-207219, filed Oct. 26, 2017, the entire contents of which are incorporated herein by reference.

FIELD

Embodiments described herein relate generally to an image forming system.

BACKGROUND

In recent years, toners (colorants) for special colors such as gold, silver and fluorescents have been developed. A decolorable toner that can become substantially colorless with heat has also been developed. Image forming apparatuses which can form images with full standard colors and special colors have thus been developed. However, since typically an image forming apparatus requires inclusion of an image forming station for the special color(s) in addition to those for full standard colors, there is a problem with increasing cost for such systems.

DETAILED DESCRIPTION

In accordance with an embodiment, an image forming system includes a sheet supply section configured to supply a sheet and a registration roller configured to guide the sheet supplied from the sheet supply section along a conveyance path. A first image forming section is configured to form a first image on the sheet based on reference image information using a first colorant type that is capable of being fixed to the sheet by heat. A fixing section is configured to heat the sheet on which the first image has been formed. A second image forming section is configured to receive the sheet from the fixing section and form a second image using a second colorant type on the sheet after the sheet has been passed through the fixing section. A controller is configured to control a heating temperature of the fixing section in two or more stages.

Hereinafter, an image forming system and other aspects of example embodiments will be described with reference to the accompanying drawings.

Figure 1:
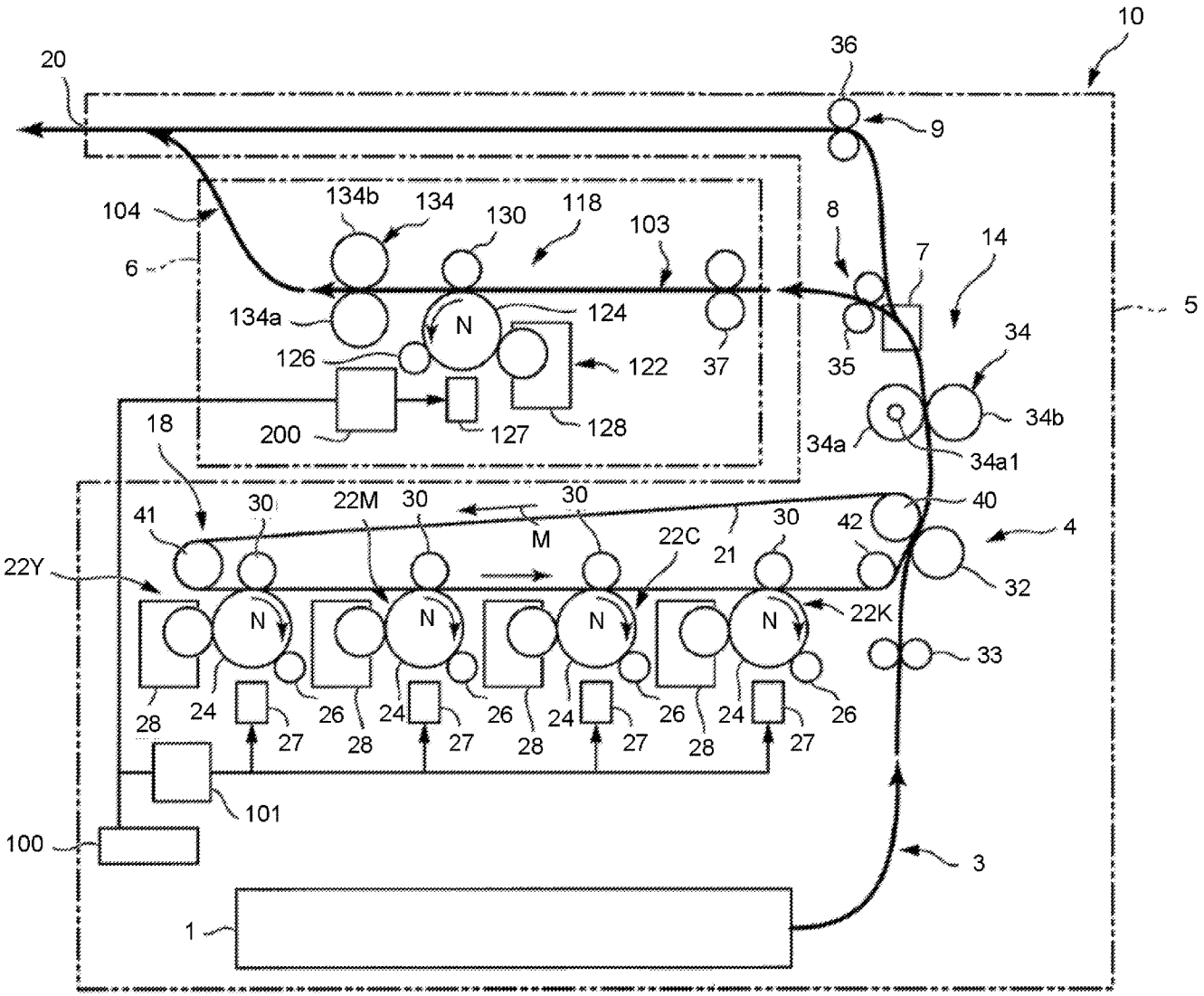
FIG. 1 is a diagram illustrating a configuration of an image forming system according to a first embodiment.

FIG. 1 is a diagram illustrating a configuration of an image forming system 10 according to a first embodiment. A Multi-Function Peripheral (MFP) 10 is described as one example of an image forming system 10.

As shown in FIG. 1, the MFP 10 includes a first image forming apparatus 5 and a second image forming apparatus 6.

The first image forming apparatus 5 includes a scanner, a control panel, and a main body section 14. The scanner reads a document image. The control panel includes input keys and a display section. For example, the input keys receive an input from a user. The scanner, the control panel, and the main body section 14 each are provided with a separate controller. The MFP 10 also includes a system controller 100 for controlling each separate controller and providing collective, overall control of MFP 10.

The main body section 14 includes a sheet feed section 1, a first conveyance section 3, a printer section 18, a conveyance path switching section 7, a second conveyance section 8, and a third conveyance section 9. Hereinafter, for components and/or sections, the side closer, along the sheet conveyance direction, to sheet feed section 1 is referred to as an "upstream side" and the side closer to the sheet discharge section 20 is referred to as a "downstream side".

The sheet feed section 1 houses a plurality of sheets, which are also referred to as image receiving media. The sheet feed section 1 includes a pickup roller (not specifically depicted) for feeding a sheet to the first conveyance section 3.

The first conveyance section 3 has a registration roller 33. The registration roller 33 moves the sheet that has been fed from the sheet feed section 1 towards a transfer section 4.

The printer section 18 forms a first image on the sheet. For example, the printer section 18 executes image formation based on a document image read with the scanner. The printer section 18 is provided with an intermediate transfer belt 21. The printer section 18 supports the intermediate transfer belt 21 with a backup roller 40, a driven roller 41 and a tension roller 42. The backup roller 40 is provided with a driving section (not shown). The printer section 18 rotates the intermediate transfer belt 21 in the arrow M direction depicted in FIG. 1.

The printer section 18 includes a set of four image forming stations 22Y, 22M, 22C and 22K. This set may be collectively referred to as a first image forming section. The image forming stations 22Y, 22M, 22C and 22K are used to form yellow, magenta, cyan, and black images, respectively. The image forming stations 22Y, 22M, 22C and 22K are arranged in parallel along a rotation direction of the intermediate transfer belt 21.

Hereinafter, from among the image forming stations 22Y, 22M, 22C and 22K, the image forming station 22Y is described as a representative example since the image forming stations 22M, 22C and 22K have substantially the same structure as image forming station 22Y.

The image forming station 22Y includes a photoconductive drum 24, an electrostatic charger 26, an exposure scanning head 27, a developing device 28 and a primary transfer roller 30. The electrostatic charger 26, the exposure scanning head 27, and the developing device 28 are arranged in the vicinity of the photoconductive drum 24, which rotates in an arrow N direction (axial rotation).

The primary transfer roller 30 faces the photoconductive drum 24 across the intermediate transfer belt 21. The image forming station 22Y exposes the photoconductive drum 24 with the exposure scanning head 27 after the photoconductive drum 24 is charged by the electrostatic charger 26. The image forming station 22Y forms an electrostatic latent image on the photoconductive drum 24. The developing device 28 uses a two-component developing agent composed of a toner and a carrier to develop the electrostatic latent image on the photoconductive drum 24.

The primary transfer roller 30 first transfers a toner image from the photoconductive drum 24 onto the intermediate transfer belt 21 as the photoconductive drum 24 rotates. The image forming stations 22Y, 22M, 22C and 22K together form a color toner image on the intermediate transfer belt 21 along with the primary transfer roller 30. The color toner image is formed by overlapping Y (yellow), M (magenta), C (cyan) and K (black) toner images. The toners used in the image forming stations 22Y, 22M, 22C and 22K are referred to as a first colorant type or normal toner.

The printer section 18 includes the transfer section 4. The transfer section 4 includes the backup roller 40 and a secondary transfer roller 32. The secondary transfer roller 32 faces the backup roller 40 across the intermediate transfer belt 21. The secondary transfer roller 32 transfers the color toner image formed on the intermediate transfer belt 21 onto the sheet to form a first image.

The printer section 18 includes a fixing section 34. The fixing section 34 includes a heat roller 34*a* and a pressure roller 34*b*. The heat roller 34*a* includes a heating section 34*a*1 therein. For example, the heating section 34*a*1 is a heater lamp, an induction heater (IH) heater, or the like. The pressure roller 34*b* presses the sheet between the pressure roller 34*b* and the heat roller 34*a*. The fixing section 34 fixes the image by applying heat and pressure to the sheet with the heat roller 34*a* and the pressure roller 34*b*.

In a normal operation mode, the fixing section 34 fixes an image formed with a normal toner at a normal toner fixing temperature for the normal toner. The normal fixing temperature is, for example, 140° C. or higher (for example, 140° C. to 160° C.).

The fixing section 34 can also operate in a low temperature operation mode, that is, a fixing operation performed at a temperature lower than the normal fixing temperature (e.g., 80° C. to 100° C.). The fixing section 34 can also operate in a non-heating mode in which the sheet is not substantially heated. The temperature of the sheet in the non-heating mode is, for example, 60° C. or less. The fixing section 34 can also operate in a decoloring operation mode at a decoloring temperature corresponding to a decolorable toner. The decoloring temperature is a temperature at which the decolorable toner becomes decolored, and is, for example, 140° C. or higher (for example, 140° C. to 160° C.).

In some examples, the conveyance path switching section 7 is a flap-like switching member. The conveyance path switching section 7 is arranged on the downstream side of the fixing section 34. The conveyance path switching section 7 can switch the destination of a sheet between the second conveyance section 8 and the third conveyance section 9. The operation of the conveyance path switching section 7 is controlled by the system controller 100.

The second conveyance section 8 includes a conveyance roller 35. The conveyance roller 35 transports the sheet passing through the conveyance path switching section 7 towards the second image forming apparatus 6.

The third conveyance section 9 includes a conveyance roller 36. The conveyance roller 36 transports the sheet passing through the conveyance path switching section 7 towards the sheet discharge section 20 without passing through the second image forming apparatus 6.

The second image forming apparatus 6 includes a fourth conveyance section 103, a printer section 118, a fixing section 134, a fifth conveyance section 104, and a controller 200.

The fourth conveyance section 103 includes a conveyance roller 37. The conveyance roller 37 conveys a sheet from the second conveyance section 8 towards the printer section 118.

The printer section 118 includes an image forming station 122, also referred to as second-type image forming section in some contexts. The image forming station 122 includes a photoconductive drum 124, an electrostatic charger 126, an exposure scanning head 127, a developing device 128, and a transfer roller 130. The photoconductive drum 124 rotates in a direction indicated by the N arrow (axially rotation). For example, the printer section 118 forms an image that is based on the previously provided image information.

The image forming station 122 exposes the photoconductive drum 124 with the exposure scanning head 127 after the photoconductive drum 124 has been charged by the electrostatic charger 126. The image forming station 122 forms an electrostatic latent image on the photoconductive drum 124. The developing device 128 develops an electrostatic latent image on the photoconductive drum 124. The transfer roller 130 transfers a toner image formed on the photoconductive drum 124 onto the sheet to form a second image. The toner used in the image forming station 122 is a second colorant type. The second colorant type is, for example, a decolorable toner that can become substantially colorless by heating. The second colorant type may instead be a toner for a special color such as gold, silver, or a fluorescent color. In this context, a special color is any color other than Y, M, C and K. Thus, the second colorant type may be a decolorable toner (of any initial color) or a special color toner.

The fixing section 134 includes a heat roller 134*a* and a pressure roller 134*b*. The heat roller 134*a* includes a heating section therein. The pressure roller 134*b* presses the sheet between the pressure roller 134*b* and the heat roller 134*a*. The fixing section 134 fixes the image by applying heat and pressure to the sheet with the heat roller 134*a* and the pressure roller 134*b*.

In the low temperature operation mode, the fixing section 134 fixes an image formed with the decolorable toner on the sheet at a decoloring toner fixing temperature (for example, 80° C. to 100° C.) that is lower than a normal fixing temperature. The decoloring toner fixing temperature is a temperature at which the decolorable toner can be fixed to a sheet without being decolored.

The fixing section 134 can also operate in the normal operation mode. In other words, the fixing section 134 can also fix the image formed with a normal type toner at a normal fixing temperature in the normal operation mode. The fixing section 134 can also operate in a non-heating mode in which the sheet is not heated. The fixing section 134 can also operate in the decoloring operation mode.

The fifth conveyance section 104 conveys a sheets passing through the fixing section 134 towards the sheet discharge section 20. The controller 200 can control the operations of the image forming station 122 and the fixing section 134.

The system controller 100 can control a heating temperature of the fixing section 34 of the printer section 18. In other words, the system controller 100 can select any one of the normal operation mode, the low temperature operation mode, the non-heating mode, and the decoloring operation mode for the fixing section 34.

The system controller 100 can also control the operation of the fixing section 134 of the printer section 118 via the controller 200. In other words, the system controller 100 can select any one of the normal operation mode, the low temperature operation mode, the non-heating mode, and the decoloring operation mode for the fixing section 134.

The fixing sections 34 and 134 may operate in at least two operation modes (for example, the normal operation mode and the low temperature operation mode) with different temperatures. Thus, the system controller 100 can control the heating of the sheet in two or more stages by control of the fixing sections 34 and 134.

The MFP 10 includes a memory 101 (storage section). For example, the memory 101 is, for example, a RAM (Random Access Memory). In the memory 101, reference image information, which is the basis of the image to be formed by the printer section 18, can be recorded. When printing using only the first image forming apparatus 5, the reference image information is data for the image that is formed by the first image forming apparatus 5. When the printing is performed using both the first image forming apparatus 5 and the second image forming apparatus 6, the reference image information includes image data to be printed by the first image forming apparatus 5 and image data to be printed by the second image forming apparatus 6. For example, the reference image information includes information for the images formed with the four color (Y, M, C and K) toners and the decolorable toner.

The second image forming apparatus 6 can be provided in a sheet discharging section built in or installed in the first image forming apparatus 5. As a result, the MFP 10 can have a reduced footprint.

The second image forming apparatus 6 may be attachable to the first image forming apparatus 5. Therefore, it is possible to manufacture or provide a MFP 10 according to embodiments of the present disclosure by modifying an existing image forming apparatus to obtain a first image forming apparatus 5, and then attaching a second image forming apparatus 6 to the first image forming apparatus 5. Therefore, the MFP 10 can be provided at low cost. Therefore, a user who does not use the special toner frequently can still conveniently use the MFP 10.

Figure 2:
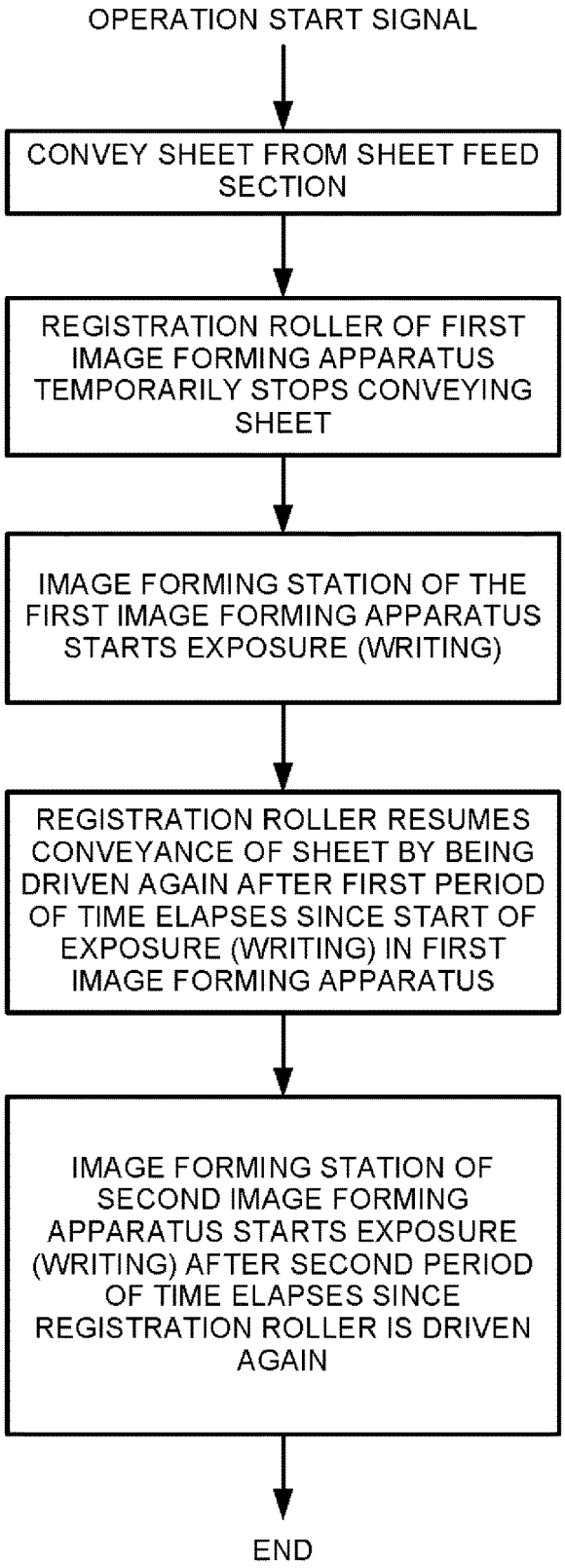
FIG. 2 is a flowchart for depicting an operation of the image forming system according to the first embodiment.
Figure 3:
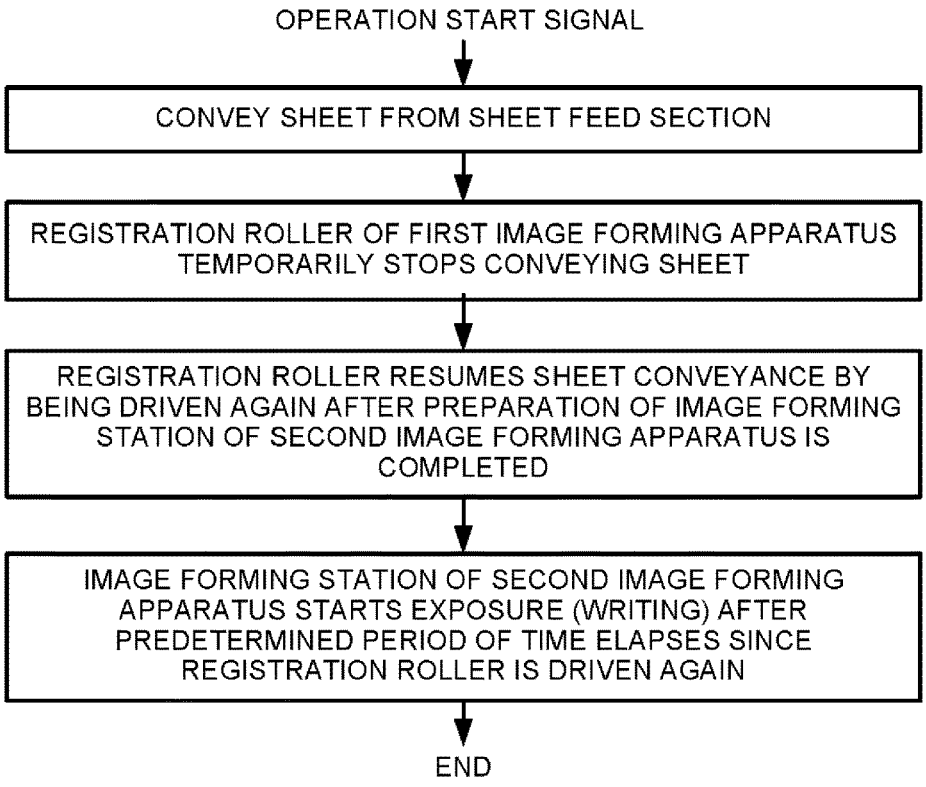
FIG. 3 is a flowchart for depicting the operation of the image forming system according to the first embodiment.
Figure 4:
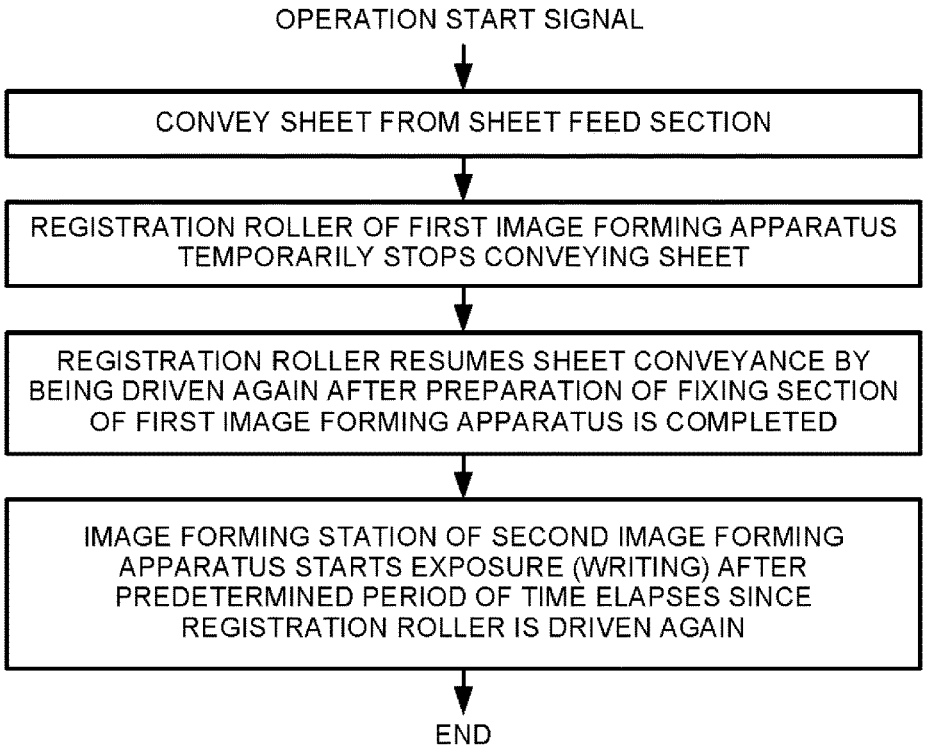
FIG. 4 is a flowchart for depicting the operation of the image forming system according to the first embodiment.

Next, with reference to FIG. 2 to FIG. 4 in addition to FIG. 1, an example of an operation of the MFP 10 is described. In the example of the operation described below, in the image forming stations 22Y, 22M, 22C, and 22K of the first image forming apparatus 5, normal toners of Y, M, C and K types are used, respectively. The normal toners can be fixed on the sheet at a normal fixing temperature (for example, 140° C. or higher).

In the image forming station 122 of the second image forming apparatus 6, a decolorable toner is used. The decolorable toner will become decolored at the normal fixing temperature (of the normal toners), and will not become decolored at a temperature lower than a decoloring temperature (for example, 100° C. or lower).

(1) Operation Example 1: Printing Using Only the First Image Forming Apparatus

The system controller 100 sends an operation start signal to the sheet feed section 1. The sheet feed section 1 then feeds a sheet to the first conveyance section 3. The first conveyance section 3 conveys the sheet towards the transfer section 4. The transfer section 4 forms a first image on the sheet. The fixing section 34 operates in the normal operation mode and fixes the image on the sheet at the normal fixing temperature for the normal toner. The normal fixing temperature is, for example, 140° C. or more (for example, 140° C. to 160° C.).

The system controller 100 performs control to convey the sheet passed through the fixing section 34 to the third conveyance section 9 by operation of the conveyance path switching section 7. The third conveyance section 9 conveys the sheet to the sheet discharge section 20 without passing the sheet through the second image forming apparatus 6. The sheet passed through the sheet discharge section 20 is conveyed to, for example, a post-processing apparatus (e.g., collating, binding, stapling etc.). In the operation example 1, the second image forming apparatus 6 is not used.

(2) Operation Example 2: Printing Using the First Image Forming Apparatus and the Second Image Forming Apparatus As shown in FIG. 2, the system controller 100 sends an operation start signal to the sheet feed section 1. As shown in FIG. 1, the sheet feed section 1 feeds the sheet to the first conveyance section 3. The first conveyance section 3 conveys the sheet towards the transfer section 4. At this time, the registration roller 33 temporarily stops conveying the sheet, and while in the sheet is in the stopped state, the exposure scanning head 27 for each of the image forming stations 22Y, 22M, 22C and 22K starts exposure (writing).

As shown in FIG. 2, the registration roller 33 resumes the conveyance of the sheet after a first period of time (time t1) elapses after the start of the exposure. The transfer section 4 forms a first image on the sheet. The fixing section 34 operates in the normal operation mode to fix the image on the sheet at the normal fixing temperature (for example, 140° C. or higher (e.g., 140° C. to 160° C.)).

The system controller 100 performs control to convey the sheet passed through the fixing section 34 to the second conveyance section 8 by operation of the conveyance path switching section 7. The second conveyance section 8 conveys the sheet to the fourth conveyance section 103 of the second image forming apparatus 6. The fourth conveyance section 103 conveys the sheet to the image forming station 122.

As noted in FIG. 2, after a second period of time (time t2) elapses after the registration roller 33 has been driven again, the system controller 100 preforms control in such a manner that the exposure scanning head 127 of the image forming station 122 starts exposure (writing). The photoconductive drum 124 forms a second image onto the sheet. The fixing section 134 operates in the low temperature operation mode to fix the second image on the sheet at a fixing temperature for the decolorable toner. The fixing temperature for the decolorable toner is a temperature at which the decolorable toner can be fixed without being decolored. The decolorable toner fixing temperature is, for example, 80° C. to 100° C.

The fifth conveyance section 104 conveys the sheet to the sheet discharge section 20. The sheet passed through the sheet discharge section 20 is conveyed to, for example, a post-processing apparatus.

There is no registration roller in the second image forming apparatus 6 of this example; however, if a second registration roller was present in a second image forming apparatus 6, it can be assumed that the operation of the forming station 122 would be controlled according to the operation of the second registration roller. In such a case, there would be a possibility that a tip of the sheet would stop at the second registration roller and a back end of the sheet would not be separated from the fixing section 34 of the first image forming apparatus 5, which would lead to excessive heating of the sheet by the fixing section 34. The excessive heating of the sheet may cause uneven glossiness or the like on the sheet.

In the MFP 10 of the present example, the second image forming apparatus 6 does not have a registration roller. The MFP 10 controls the operation of the image forming station 122 of the second image forming apparatus 6 according to the operation of the registration roller 33 in the first image forming apparatus 5. Therefore, the sheet can be guided into the image forming station 122 without stopping. Therefore, even if the sheet is long in a conveyance direction thereof, the problem of excessive heating of the sheet by the fixing section 34 as described above is unlikely to occur. Even when the distance between the fixing section 34 and the image forming station 122 is short, the problem of excessive heating of the sheet by the fixing section 34 is unlikely to occur in the MFP 10. Therefore, the MFP 10 can be designed in such a manner that the distance between the fixing section 34 and the image forming station 122 is short, which is advantageous for miniaturization of the MFP 10. Also, since the second image forming apparatus 6 of the MFP 10 does not have a registration roller, the structure of the second image forming apparatus 6 is simplified, thereby aiding the miniaturization of the MFP 10.

(3) Operation Example 3: Printing Using Only the Second Image Forming Apparatus

As shown in FIG. 3, the system controller 100 sends an operation start signal to the sheet feed section 1. The sheet feed section 1 feeds a sheet to the first conveyance section 3. The first conveyance section 3 conveys the sheet towards the transfer section 4. As shown in FIG. 3, at this time, the registration roller 33 may temporarily stop conveyance of the sheet. After the preparation of the image forming station 122 of the second image forming apparatus 6 has been completed, the registration roller 33 resumes sheet conveyance by being driven again.

Since no image is being formed in the first image forming apparatus 5, the fixing section 34 can operate at a lower temperature than the normal operation mode. The fixing section 34 may operate in the non-heating mode (in which the fixing section 34 is not heated), or may operate in the low temperature operation mode.

The system controller 100 performs control to convey the sheet passed through the fixing section 34 to the second conveyance section 8 by operation of the conveyance path switching section 7. The second conveyance section 8 conveys the sheet to the fourth conveyance section 103 of the second image forming apparatus 6. The fourth conveyance section 103 conveys the sheet towards the image forming station 122.

As shown in FIG. 3, after a predetermined period of time (time t3) elapses after the registration roller 33 has been driven again, the system controller 100 performs control in such a manner that the exposure scanning head 127 of the image forming station 122 starts exposure (writing). The photoconductive drum 124 forms a second image on the sheet. The fixing section 134 operates in the low temperature operation mode to fix the second image on the sheet at the fixing temperature for the decolorable toner (for example, 80° C. to 100° C.).

The fifth conveyance section 104 conveys the sheet to the sheet discharge section 20. The sheet passed through the sheet discharge section 20 is conveyed to, for example, the post-processing apparatus.

In the operation example 3, as in operation example 2, the MFP 10 controls the operation of the image forming station 122 of the second image forming apparatus 6 according to the operation of the registration roller 33 in the first image forming apparatus 5. Therefore, the problem of excessive heating of the sheet by the fixing section 34 is unlikely to occur. Therefore, being operable in a manner corresponding to operation example 3 is advantageous towards miniaturization of the MFP 10.

(4) Operation Example 4: Image Erasing Using the First Image Forming Apparatus, and Printing Using the Second Image Forming Apparatus As shown in FIG. 4, the system controller 100 sends an operation start signal to the sheet feed section 1. The sheet feed section 1 feeds a sheet to the first conveyance section 3. An image has already been formed with a decolorable toner on the sheet conveyed from the sheet feed section 1. The first conveyance section 3 conveys the sheet towards the transfer section 4. As shown in FIG. 4, at this time, the registration roller 33 may temporarily stop conveyance of the sheet. The registration roller 33 resumes the conveyance of the sheet after the preparation of the fixing section 34 has been completed. The fixing section 34 heats the sheet to a decoloring temperature (140° C. or more (for example, 140° C. to 160° C.)) in the decoloring operation mode. As a result, the image that has been formed with the decolorable toner on the sheet is decolored.

The system controller 100 performs control to convey the sheet passed through the fixing section 34 to the second conveyance section 8 by operation of the conveyance path switching section 7. The second conveyance section 8 conveys the sheet to the fourth conveyance section 103 of the second image forming apparatus 6. The fourth conveyance section 103 conveys the sheet towards the image forming station 122.

As shown in FIG. 4, after a predetermined period of time (time t4) elapses after the registration roller 33 has been driven again, the system controller 100 performs control in such a manner that the exposure scanning head 127 of the image forming station 122 starts exposure (writing). The photoconductive drum 124 forms a second image on the sheet. The fixing section 134 operates in the low temperature operation mode to fix this second image on the sheet at the fixing temperature for the decolorable toner (for example, 80° C. to 100° C.).

The fifth conveyance section 104 conveys the sheet to the sheet discharge section 20. The sheet passed through the sheet discharge section 20 is sent to, for example, the post-processing apparatus.

In the MFP 10, the heating temperature in the fixing section 34 of the first image forming apparatus 5 can be controlled in stages according to the operation modes of the first image forming apparatus 5 and the second image forming apparatus 6. Therefore, for example, in the operation examples 1, 2, and 4, the fixing section 34 can operate in the normal operation mode or in the decoloring operation mode. In the operation example 3, the fixing section 34 can operate in the low temperature operation mode or in the non-heating mode. Therefore, it is possible to perform printing with the special color toner (e.g., decolorable toner) and printing with normal toner in a plurality of modes.

Since the sheet feed section 1, the image forming stations 22Y, 22M, 22C, and 22K, the post-processing apparatus, and the like in the first image forming apparatus 5 have configurations the same as or similar to those in a conventional image forming apparatus, it is possible to use an existing image forming apparatus without making a significant design changes. The MFP 10 can be simply constituted by attaching a second image forming apparatus 6 to a first image forming apparatus 5. Therefore, the MFP 10 can be manufactured at the low cost due to the small design change when compared with an image forming apparatus in which, for example, the image forming station for special toner and the image forming stations for four colors must be incorporated in one printer apparatus. Therefore, the MFP 10 can be provided at a lower price. Since the MFP 10 is manufactured at the low cost, a user who does not use the special toner frequently can still conveniently use the MFP. Since the MFP has a simple configuration as described above, miniaturization can be realized.

Figure 5:
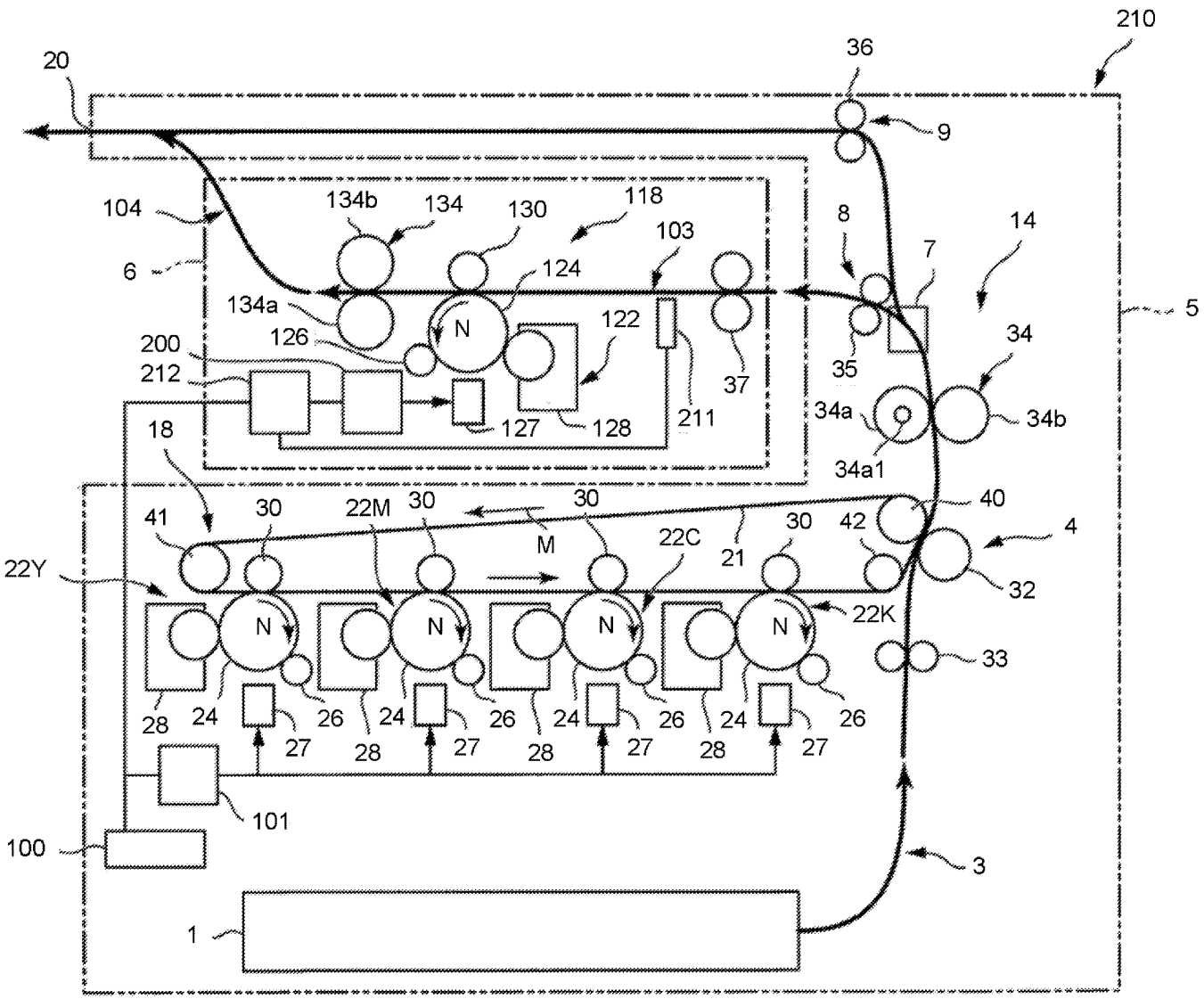
FIG. 5 is a diagram illustrating a configuration of an image forming system according to a second embodiment.
Figure 6:
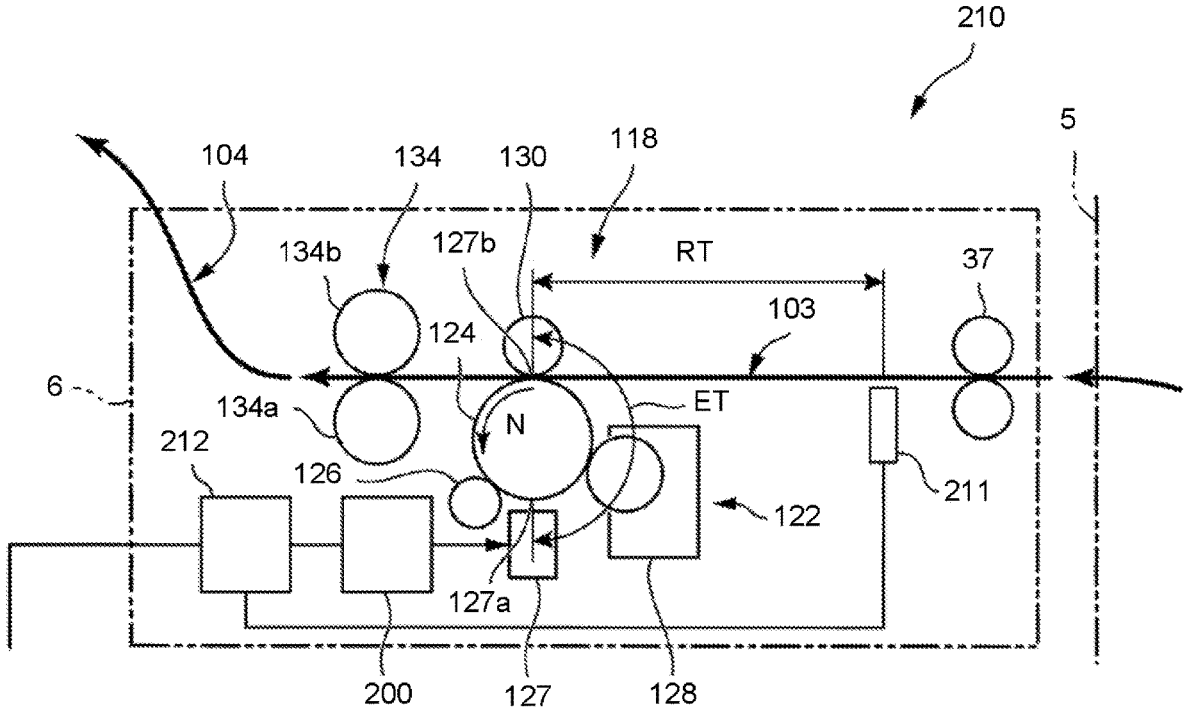
FIG. 6 is a diagram illustrating a positional relationship between a reading section and an image forming station in the image forming system according to the second embodiment.

FIG. 5 is a diagram illustrating a configuration of an image forming system 210 (also referred to as a MFP 210) according to a second embodiment. FIG. 6 is a diagram for explaining the positional relationship between a reading section 211 and an image forming station 122 in the MFP 210. The components that are substantially the same as those in the first embodiment are denoted with the same reference numerals as used above in description of the first embodiment, and additional description thereof may be omitted.

As shown in FIG. 5 and FIG. 6, the MFP 210 has the same configuration as the MFP 10 (shown in FIG. 1) except that the MFP 210 includes the reading section 211 and a reception section 212.

The reading section 211 is provided between the fixing section 34 and the image forming station 122 (specifically, the fourth conveyance section 103). The reading section 211 is, for example, a scanner or a scanning sensor. The reading section 211 reads information relating to the sheets conveyed to the fourth conveyance section 103, and sends a signal corresponding to the information that has been read to the reception section 212. The information sent by the reading section 211 to the reception section 212 is stored in the memory 101.

The photoconductive drum 124 rotates in the direction of the arrow N to transfer the toner image onto a sheet.

As shown in FIG. 6, a distance along the sheet conveyance direction from the reading section 211 to a transfer position 127*b* of the photoconductive drum 124 is set as a distance RT. A distance along a rotation direction of the photoconductive drum 124 (corresponding to a distance along an outer circumferential surface of the photoconductive drum 124) from an exposure position 127*a* to the transfer position 127*b* of the photoconductive drum 124 is set as distance ET. The distance RT is longer than the distance ET. In a case in which the distance RT is equal to or less than the distance ET, even when an exposure timing is changed based on the information obtained by the reading section 211, there is a possibility that the correction of the image (e.g., a change in the image position or the like) cannot match up with the corresponding position of the sheet. On the other hand, if the distance RT is longer than the distance ET, the correction of the image based on the information obtained by the reading section 211 can be reliably reflected on the image transferred onto the sheet.

The reception section 212 receives the information sent from the reading section 211. The reception section 212 receives, from the memory 101, the reference image information that is the basis of the image already formed on the sheet by the first image forming apparatus 5.

The system 100 compares the as-read information sent from the reading section 211 to the reception section 212 with the reference image information. For example, the as-read information relates to presence or absence of the sheet that is being conveyed to the second conveyance section 8, or relates to the position or size of the first image formed already on the sheet. For example, the reference image information is information of the above-described images that have been formed with toners of the four colors (Y, M, C and K) and the decolorable toner.

The system controller 100 controls the operation of the image forming station 122 with the controller 200 based on the result of the comparison. For example, by selecting a start timing of the exposure in the image forming station 122, the position of the toner image can be adjusted in accordance with the position of the sheet. Thus, the position of the second image on the sheet can be optimized. The system controller 100 can also adjust (e.g., reduce or enlarge) a size of the second toner image to be formed on the sheet in accordance with the actual size of the sheet with the controller 200. Thus, even when a sheet contracts or expands due to various factors such as moisture absorption, heating in the fixing section 34 or the like, a second image having an appropriate size can be formed.

As described above, in the MFP 210, by controlling the operation of the image forming station 122 based on the comparison between the as-read information and the reference image information, the MFP 210 can form a second image having an appropriate size at an appropriate position on the sheet. In particular, in a case of forming the first image and the second image on the sheet in an overlapped manner, as in the operation example 2, matching between the first image and the second image is important. Since the MFP 210 can increase the accuracy in the formation position and the size of the second image, it is possible to form a composite image with excellent consistency.

An installation position for the second image forming apparatus 6 is not limited to a sheet discharge section of the first image forming apparatus 5, and the second image forming apparatus 6 may be incorporated in a post processing apparatus installed adjacent to the first image forming apparatus 6. The second image forming apparatus 5 may be detachable from the first image forming apparatus 6 (or MFP 10 or MFP 210). The colorant-type used in the first image forming apparatus 6 and the second image forming apparatus 5 is not limited to toners used in an electrophotographic or electrographic system, and one or both may be ink (for example, a decolorable ink) used for forming an image by an inkjet system. The first image forming apparatus 5 and the second image forming apparatus 6 may also directly transfer toner images from the photoconductive drum onto sheets rather than via a secondary transfer belt or the like.

According to at least one embodiment described above, the heating temperature in the fixing section of the first image forming apparatus 5 can be controlled in response to the selection of one of the operation modes of the first image forming apparatus 5 and the second image forming apparatus 6. Therefore, it is possible to perform the printing with a special colorant and the printing with a normal colorant in a plurality of modes.

Since in some embodiments, a first image forming apparatus 6 (or at least a portion thereof) has the same configuration as a conventional image forming apparatus, it is possible to use an existing conventional image forming apparatus design without making the significant design changes. Since the image forming system of the present disclosure can be simply constituted by attaching a second image forming apparatus 5 to the first image forming apparatus 6, such an image forming system can be manufactured at lower cost due to the small design changes required. Therefore, various embodiments of an image forming system of the present disclosure can be provided at the low cost. Therefore, a user who does not use a special toner (or special colorant) frequently can still conveniently use an image forming system of present disclosure.

While certain embodiments have been described, these embodiments have been presented by way of example only, and are not intended to limit the scope of the present disclosure. Indeed, the novel embodiments described herein may be embodied in a variety of other forms; furthermore, various omissions, substitutions and changes in the form of the embodiments described herein may be made without departing from the spirit of the present disclosure. The accompanying claims and their equivalents are intended to cover such forms or modifications as would fall within the scope and spirit of the present disclosure.

What is claimed is:

1. An image forming system, comprising:

a sheet supply section configured to supply a sheet;

a registration roller configured to guide the sheet supplied from the sheet supply section along a conveyance path;

a first image forming section configured to form a first image on the sheet using a first colorant type that is capable of being fixed to the sheet at a first temperature or higher;

a first fixing section configured to heat the sheet conveyed thereto through the first image forming section;

a second image forming section configured to receive the sheet from the first fixing section and form a second image on the sheet using a second colorant type that is decolorable when heated above a decoloring threshold temperature;

a second fixing section configured to heat the sheet conveyed thereto through the second image forming section; and a controller configured to control a heating temperature of the first fixing section when the sheet is conveyed through the first image forming section to the first fixing section, according to an operating mode that is selected from a plurality of operating modes, the plurality of operating modes including a first operating mode in which the first fixing section is heated to a second temperature that is lower than the first temperature and the decoloring threshold temperature, and a second operating mode in which the first fixing section is heated to a third temperature that is higher than the decoloring threshold temperature.

2. The image forming system according to claim 1, wherein the registration roller is between the sheet supply section and the first image forming section and the controller controls the operation of the second image forming section according to an operation of the registration roller.

3. The image forming system according to claim 1, wherein the second colorant type is a decolorable toner that becomes colorless when heated above the decoloring threshold temperature.

4. The image forming system according to claim 1, wherein the first colorant type is a toner that is one of cyan, magenta, yellow, or black in color.

5. The image forming system according to claim 1, further comprising:

a reading section between the first fixing section and the second image forming section and configured to obtain position information for the sheet, wherein the second image forming section includes:

a photoconductive drum configured to transfer a toner image onto the sheet, a charger configured to charge a surface of the photoconductive drum, an exposure section configured to expose the photoconductive drum at an exposure position and form an electrostatic latent image on the photoconductive drum, and a developing device configured to provide developer including the second colorant type to develop the electrostatic latent image and form the toner image, a distance in a sheet conveyance direction from the reading section to a transfer position for the toner image to the sheet from the photoconductive drum is greater than a distance along a rotation direction of the photoconductive drum from the exposure position to the transfer position, and the controller controls the operation of the second image forming section based on the position information obtained by the reading section.

6. The image forming system according to claim 5, wherein the controller controls the second image forming section based on the position information obtained by the reading section and reference image information used to form the first image.

7. The image forming system according to claim 1, wherein in the first and second operating modes, the first image is not formed on the sheet by the first image forming section when the sheet is conveyed through the first image forming section.

8. An image forming system, comprising:

a first image forming apparatus comprising:

a sheet feed section for storing sheets;

a first conveyance section including a first registration roller and configured to transport a sheet from the sheet feed section;

a first image forming section receiving the sheet from the first conveyance section and including four image forming stations corresponding to four different colors, the four image forming stations configured to form a first image on the sheet using a first colorant type that is capable of being fixed to the sheet at a first temperature or higher;

a first fixing section configured to heat the sheet conveyed thereto through the first image forming section; and a controller configured to control a heating temperature of the first fixing section; and a second image forming apparatus comprising:

a second image forming section configured to receive the sheet from the first fixing section and form a second image on the sheet using a second colorant type that is decolorable when heated above a decoloring threshold temperature;

a second conveyance section provided between the first fixing section and the second image forming section; and a second fixing section configured to heat the sheet conveyed thereto through the second image forming section, wherein the controller controls the heating temperature of the first fixing section when the sheet is conveyed through the first image forming section to the first fixing section, according to an operating mode that is selected from a plurality of operating modes, the plurality of operating modes including a first operating mode in which the first fixing section is heated to a second temperature that is lower than the first temperature and the decoloring threshold temperature, and a second operating mode in which the first fixing section is heated to a third temperature that is higher than the decoloring threshold temperature.

9. The image forming system according to claim 8, wherein the second image forming apparatus is detachable from the first image forming apparatus.

10. The image forming system according to claim 8, wherein the first image forming apparatus is a multi-functional peripheral device.

11. The image forming system according to claim 8, wherein the second image forming apparatus includes a reading section configured to obtain position information for the sheet in the second conveyance section.

12. The image forming system according to claim 11, wherein the second image forming apparatus further includes a reception section configured to receive reference information for the first image from the first image forming apparatus and the controller controls the operation of the second image forming section based on the reference information and the position information obtained by the reading section.

13. The image forming system according to claim 8, wherein in the first and second operating modes, the first image is not formed on the sheet by the first image forming section when the sheet is conveyed through the first image forming section.

14. A multi-functional peripheral device, comprising:

a sheet supply section configured to supply a sheet;

a registration roller configured to guide the sheet supplied from the sheet supply section along a conveyance path;

a first printer section including:

a first image forming section configured to form a first image on the sheet using a first colorant type that is capable of being fixed to the sheet at a first temperature or higher; and a first fixing section configured to heat the sheet conveyed thereto through the first image forming section;

a second printer section including:

a second image forming section configured to receive the sheet from the first fixing section and form a second image on the sheet using a second colorant type that is decolorable when heated above a decoloring threshold temperature; and a second fixing section configured to heat the sheet conveyed thereto through the second image forming section; and a controller configured to control a heating temperature of the first fixing section when the sheet is conveyed through the first image forming section to the first fixing section, according to an operating mode that is selected from a plurality of operating modes, the plurality of operating modes including a first operating mode in which the first fixing section is heated to a second temperature that is lower than the first temperature and the decoloring threshold temperature, and a second operating mode in which the first fixing section is heated to a third temperature that is higher than the decoloring threshold temperature.

15. The multi-functional peripheral device according to claim 14, wherein the second printer section includes a reading section configured to obtain position information before the sheet enters the second image forming section.

16. The multi-functional peripheral device according to claim 15, wherein the second printer section further includes a reception section configured to receive reference information for the first image and the controller controls the second image forming section based on the reference information and the position information obtained by the reading section.

17. The multi-functional peripheral device according to claim 14, wherein the second printer section is detachable from a body of the multi-functional peripheral device.

18. The multi-functional peripheral device according to claim 14, wherein in the first and second operating modes, the first image is not formed on the sheet by the first image forming section when the sheet is conveyed through the first image forming section.

* * * * *